US009890992B2

(12) United States Patent
Becke et al.

(10) Patent No.: US 9,890,992 B2
(45) Date of Patent: Feb. 13, 2018

(54) DOMESTIC APPLIANCE HAVING A DOOR LEAF WHICH INCLUDES A RECESSED HANDLE

(71) Applicant: BSH HAUSGERAETE GMBH, Munich (DE)

(72) Inventors: Christoph Becke, Grosskarolinenfeld (DE); Max Eicher, Munich (DE); Klaus Foersterling, Amerang (DE); Christine Hartwein, Munich (DE); Andreas Kessler, Munich (DE); Philipp Kleinlein, Munich (DE); Ralph Staud, Munich (DE); Thomas Tischer, Haar (DE); Xingen Yao, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/119,741

(22) PCT Filed: Jan. 23, 2015

(86) PCT No.: PCT/EP2015/051314

§ 371 (c)(1),
(2) Date: Aug. 18, 2016

(87) PCT Pub. No.: WO2015/124370

PCT Pub. Date: Aug. 27, 2015

(65) Prior Publication Data

US 2017/0059238 A1 Mar. 2, 2017

(30) Foreign Application Priority Data

Feb. 18, 2014 (DE) ..... 10 2014 202 889

(51) Int. Cl.
*F21V 33/00* (2006.01)
*F25D 27/00* (2006.01)
(Continued)

(52) U.S. Cl.
CPC ..... *F25D 27/005* (2013.01); *F25D 23/028* (2013.01); *F25D 27/00* (2013.01); *F25D 29/003* (2013.01); *F25D 2327/001* (2013.01)

(58) Field of Classification Search
CPC . F21V 13/10; F21V 29/70; F21V 5/04; F21V 7/00; F21V 13/12; G02B 19/0028;
(Continued)

(56) References Cited

U.S. PATENT DOCUMENTS

2009/0277210 A1* 11/2009 Eveland ..... F25C 5/005 62/441
2010/0320890 A1* 12/2010 Jung ..... F25D 27/00 312/402

FOREIGN PATENT DOCUMENTS

DE 102012200810 A1 7/2013
JP H10300338 A 11/1998
(Continued)

OTHER PUBLICATIONS

Machine English Translation of KR20110005940A Jan. 20, 2011 Jung, et al.*

*Primary Examiner* — Elmito Breval
*Assistant Examiner* — Glenn Zimmerman
(74) *Attorney, Agent, or Firm* — Laurence A. Greenberg; Werner H. Sterner; Ralph E. Locher

(57) ABSTRACT

A domestic appliance, in particular a domestic refrigeration appliance, includes an interior chamber and an electronic control apparatus having an electronics system and being constructed to control at least one function of the domestic appliance during operation thereof. A door leaf for opening and closing the interior chamber has an inner face facing the interior chamber and an outer face facing away from the interior chamber. A recessed handle in the outer face includes a grip forming an indentation in the outer face. A lighting configuration has at least one lighting device, in
(Continued)

particular an LED, to illuminate the recessed handle. At least a large part of the electronics system and the at least one lighting device form a common assembly disposed within the door leaf adjacent the indentation, so that the at least one lighting device can radiate light out of the indentation into the recessed handle.

12 Claims, 3 Drawing Sheets

(51) Int. Cl.
*F27D 21/02* (2006.01)
*F25D 23/02* (2006.01)
*F25D 29/00* (2006.01)

(58) Field of Classification Search
CPC ..... G02B 27/0018; G02B 19/0061; F21Y 2101/02; F25D 27/005; F25D 27/00; F25D 2327/001; F25D 23/028; F25D 29/003
USPC ..... 362/283, 92, 94, 373, 249.1
See application file for complete search history.

(56) References Cited

FOREIGN PATENT DOCUMENTS

| | | | |
|---|---|---|---|
| KR | 20110005940 | A | 1/2011 |
| WO | 2011134738 | A2 | 11/2011 |
| WO | 2013126946 | A1 | 9/2013 |

* cited by examiner

DOMESTIC APPLIANCE HAVING A DOOR LEAF WHICH INCLUDES A RECESSED HANDLE

BACKGROUND OF THE INVENTION

Field of the Invention

The invention relates to a domestic appliance with a door leaf which includes a recessed handle. The domestic appliance is a domestic refrigeration appliance in particular.

WO 2011/124738 A2 discloses a domestic refrigeration appliance with a door leaf. The door leaf has a front outer wall, a rear inner wall and at least one side wing. The door leaf comprises a grip tray with a recessed handle which can be accessed by way of an opening in the side wing.

BRIEF SUMMARY OF THE INVENTION

It is the object of the present invention to specify an improved domestic appliance, in particular an improved domestic refrigeration appliance with a door leaf, which features a recessed handle.

The object of the invention is achieved by a domestic appliance, having an interior chamber, an electronic control apparatus which has an electronics system and which is designed to control at least one function of the domestic appliance during operation of the domestic appliance, a door leaf for opening and closing the interior chamber, said door leaf having an inner face which faces the interior chamber and an outer face which faces away from the interior chamber and a recessed handle arranged in the outer face of the door leaf and comprising a grip, which forms an indentation in relation to the outer face of the door leaf, as well as a lighting arrangement with at least one lighting means which is designed to illuminate the recessed handle, at least a large part of the electronics system and the at least one lighting means forming a common assembly which is arranged within the door leaf next to the indentation so that the at least one lighting means is able to radiate its light out of the indentation into the recessed handle. The at least one lighting means is preferably configured as at least one LED.

The inventive domestic appliance accordingly comprises the control apparatus which controls and optionally also regulates at least one function of the domestic appliance, in particular the operation of the domestic appliance. The inventive domestic appliance also comprises the door leaf. This is preferably supported in such a manner that it can be pivoted in relation to a vertically running axis and comprises a recessed handle in its outer face, which can be used to open the door leaf. The recessed handle comprises the grip which forms an indentation in relation to the outer face of the door leaf. A person's hand can thus engage in the indentation to open the door leaf. The indentation can be formed for example by a channel in a side wall of the door leaf.

The inventive domestic appliance also has the lighting arrangement which is designed to illuminate the recessed handle. The lighting arrangement comprises the at least one lighting means. This is preferably embodied as one or more LEDs.

The electronic control apparatus comprises the electronics system, in other words the part of the control apparatus which assumes the control task of the electronic control apparatus. At least a large part, if not all, of the electronics system is arranged within the door leaf. A network part provided to supply the electronics system can also be arranged in the door leaf. However this network part is preferably arranged in or on the body of the domestic appliance. The electronics system comprises for example a microprocessor or a microcontroller, generally electronic and electrical parts.

According to the invention the electronics system and the at least one lighting means form the common assembly which is in turn arranged next to the indentation of the door leaf so that the at least one lighting means is able to radiate its light out of the indentation into the recessed handle.

The inventive domestic appliance is preferably configured as a domestic refrigeration appliance, the body of which is a thermally insulated body and has an inner container which delimits the interior chamber. The interior chamber of the domestic refrigeration appliance is a chillable interior chamber and is provided for the storage of food. The domestic refrigeration appliance comprises a refrigeration apparatus for chilling the interior chamber. The electronic control apparatus is then designed to control the refrigeration apparatus in such a manner that the interior chamber has at least approximately a setpoint temperature. Control of the refrigeration apparatus, which is preferably embodied as a temperature regulator, therefore represents control of at least one function of the domestic appliance configured as a domestic refrigeration appliance.

The inventive domestic refrigeration appliance can be a domestic refrigerator for example. The chillable interior chamber is then chilled to temperatures above 0° C. The inventive domestic refrigeration appliance can also be a domestic freezer. The chillable interior chamber is then chilled to temperatures below 0° C. However the inventive domestic refrigeration appliance can also be a combined refrigerator/freezer. The inventive domestic refrigeration appliance can have just one chillable interior chamber or a number of chillable interior chambers which can also be closed and opened respectively by means of a door leaf.

The common assembly preferably comprises a single printed circuit board, to which the at least one lighting means and electrical and electronic parts of the electronics system are fastened. This embodiment can be relatively compact.

According to one preferred embodiment of the inventive domestic appliance a hollow space is arranged next to the indentation of the recessed handle, the common assembly being fastened therein, the indentation comprising a wall separating the hollow space and the recessed handle with at least one opening, through which the light from the at least one lighting means is able to radiate to illuminate the recessed handle. The hollow space can be formed in particular by a housing within the door leaf. The housing is preferably open in the direction of the outer face and closed by means of a cover in this region, thus facilitating the mounting of the door leaf. The cover preferably runs flush with the outer face.

If the inventive domestic appliance is configured as a domestic refrigeration appliance, the hollow space in which the assembly is fastened can thus be arranged next to the indentation of the recessed handle, the indentation comprising the wall separating the hollow space and the recessed handle with the at least one opening, through which the light from the at least one lighting means is able to radiate to illuminate the recessed handle. According to this variant the outer face of the door leaf in particular has an outer skin which adheres to the insulating foam and which comprises a cutout, in which a recess forming the hollow space is arranged with a housing for the assembly which is manufactured as a single piece and open in the direction of the outer face in the insulating foam, being covered by means of a cover in an outward direction. The cover preferably runs flush with the outer skin. This open housing is preferably made of plastic. The use of the open housing means that the door leaf can be manufactured relatively simply as it is relatively simple to manufacture the door leaf with the open housing including insulating foam first and then fasten the common assembly within the housing, connect it to electric cables and then close the housing with the cover.

According to one variant of the inventive domestic appliance the lighting arrangement has a light guide coupled optically to the at least one lighting means, said light guide being coupled optically to the at least one opening. The opening is configured for example as a slot. The light guide allows relatively uniform illumination of the recessed handle to be achieved. The light guide can also be part of the common assembly.

The light guide can preferably close off the at least one opening, preferably closing it completely. The light guide thus preferably forms at least a part of the wall separating the hollow space and the recessed handle.

According to a further variant of the inventive domestic appliance the recessed handle has a depression, which is only partially covered by the grip forming the indentation. Therefore a person's hand can engage in the indentation by way of the depression to open the door leaf. As the at least one lighting means is also able to radiate its light from the indentation into the recessed handle, the depression is also illuminated. The depression is preferably selected such that it reaches to the corresponding side wall of the door leaf.

According to one preferred variant of the domestic appliance the door leaf can be pivoted in relation to a vertical axis. The inventive domestic appliance can also have a further door leaf which is arranged next to the door leaf, can be pivoted in relation to a vertical axis, has an inner face and an outer face and comprises a further recessed handle arranged in the outer face of the further door leaf, said further recessed handle comprising a grip which forms an indentation in relation to the outer face of the further door leaf.

The recessed handle of the door leaf is preferably arranged in the region of the side face of the door leaf facing the further door leaf. The further recessed handle of the further door leaf is preferably arranged in the region of the side face of the further door leaf facing the door leaf. The two recessed handles are preferably at the same height so the lighting arrangement is also able to illuminate the further recessed handle. If the recessed handle comprises the depression for example, said depression preferably reaches to the side face of the door leaf facing the further door leaf. The further recessed handle can be embodied in the same manner as the recessed handle, in other words can also comprise a depression which then however reaches to the side face of the further door leaf facing the door leaf. However the further recessed handle can also be embodied simply as a channel which is arranged in the side face of the further door leaf facing the door leaf. The length of this channel preferably corresponds to the depth of the depression of the recessed handle of the door leaf. It is therefore possible for the channel of the further door leaf to be illuminated by way of the depression of the recessed handle.

If the inventive domestic appliance is a domestic refrigeration appliance, the recessed handle can in particular have said depression, its walls being molded on the open housing for the assembly.

The inventive domestic appliance provides a combination of electronics system and grip in one element (common assembly). It is therefore optionally possible for the printed circuit board, to which the electrical and electronic parts and the at least one lighting means are fastened, to be arranged directly next to the recessed grip or handle. If the at least one lighting means is LEDs which are fastened to the printed circuit board, said LEDs can radiate laterally into the recessed handle for example directly or by way of a light guide. Their light can therefore illuminate the point of engagement.

The lighting arrangement can also be used to visualize switching states or alarm states of the domestic appliance. For example in the case of a door alarm the light of the lighting arrangement can assume a defined color, for example red. The door alarm is activated for example when the door leaf is open for a predefined time period. The lighting arrangement can optionally also flash with the alarm.

A so-called "holiday function" (standby function) for example could be indicated by white light from the lighting arrangement, in particular increasing and decreasing in intensity slowly, changing brightness at the speed of slow breathing.

The visualization of further functions such as "eco cooling" (energy saving mode) for example can be visualized by green light for example or "super" can be visualized by bright white light.

The lighting arrangement can optionally also be embodied as interactive, in that for example the electronics system automatically activates the at least one lighting means when a person approaches the inventive domestic appliance or the recessed handle. To this end the domestic appliance can comprise for example a distance or proximity sensor which is connected to the electronics system. The distance or proximity sensor can be fastened in or to the outer face of the door leaf for example.

BRIEF DESCRIPTION OF THE SEVERAL VIEWS OF THE DRAWING

An exemplary embodiment of the invention is illustrated by way of example in the accompanying schematic drawings, in which.

DESCRIPTION OF THE INVENTION

Figure 1:
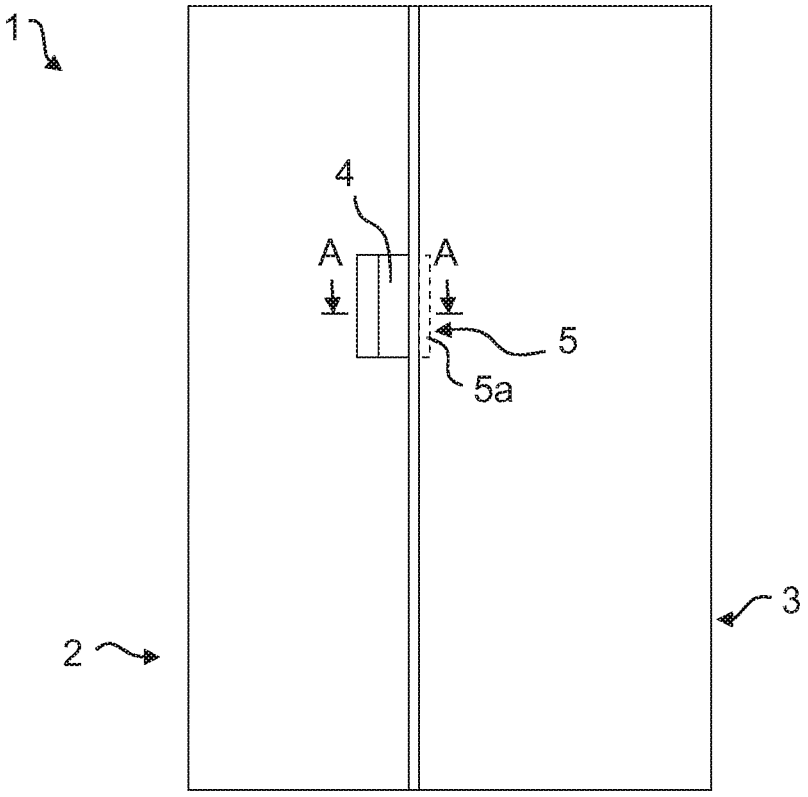
FIG. 1 shows a domestic refrigeration appliance with two door leaves arranged next to one another, each having a recessed handle.

FIG. 1 shows a front view of a domestic refrigeration appliance as an example of a domestic appliance with at least one door leaf.

As known in principle to the person skilled in the art, the domestic refrigeration appliance 1 has a thermally insulated body (not shown in detail) with an inner container, which delimits a chillable interior chamber.

The domestic refrigeration appliance 1 shown in FIG. 1 is in particular a combined refrigerator/freezer, which is configured in particular as what is referred to as a side by side appliance and therefor comprises a first chillable interior chamber and a second chillable interior chamber arranged next to the first chillable interior chamber, these being separated from one another in particular by a vertical, thermally insulated separating wall. The two interior chambers can be delimited for example by a single inner container. However an individual inner container can also be provided for each of the two chillable interior chambers.

The domestic refrigeration appliance 1 can be embodied as what is referred to as a frost-free domestic refrigeration appliance.

The chillable interior chambers are provided for the storage of food. Trays and/or drawers for storing the food can be arranged within the interior chambers. Provision is made in particular for one of the two chillable interior chambers, e.g. the first chillable interior chamber, which is on the left in the present exemplary embodiment, to be provided for the storage of frozen goods and for the second chillable interior chamber to be provided for the storage of chilled goods.

The domestic refrigeration appliance 1 comprises a refrigeration apparatus (not shown in detail) known in principle to the person skilled in the art, in the form of at least one refrigerant circuit for chilling the two chillable interior chambers. The refrigerant circuit comprises for example a compressor, a condenser connected downstream of the compressor, a throttle apparatus connected downstream of the condenser and embodied in particular as a throttle or capillary tube and an evaporator, which is arranged between the throttle apparatus and the compressor.

In the present exemplary embodiment the domestic refrigeration appliance 1 comprises an electronic control apparatus, which is designed to control the refrigeration apparatus, in particular the compressor of the refrigerant circuit in a manner generally known to the person skilled in the art such that the chillable interior chambers have at least approximately predefined or predefinable setpoint temperatures. The electronic control apparatus is preferably designed in such a manner that it regulates the temperatures of the chillable interior chambers, as known in principle to the person skilled in the art. In order to obtain the actual temperatures of the chillable interior chambers as required, the domestic refrigeration appliance 1 can have temperature sensors (not show in detail) which are connected to the control apparatus. In particular during operation of the domestic refrigeration appliance 1 the setpoint temperature of the first chillable interior chamber is below 0° C. and the setpoint temperature of the second chillable interior chamber is above 0° C.

In the present exemplary embodiment the domestic refrigeration appliance 1 has a first door leaf 2 and a second door leaf 3.

Figure 2:
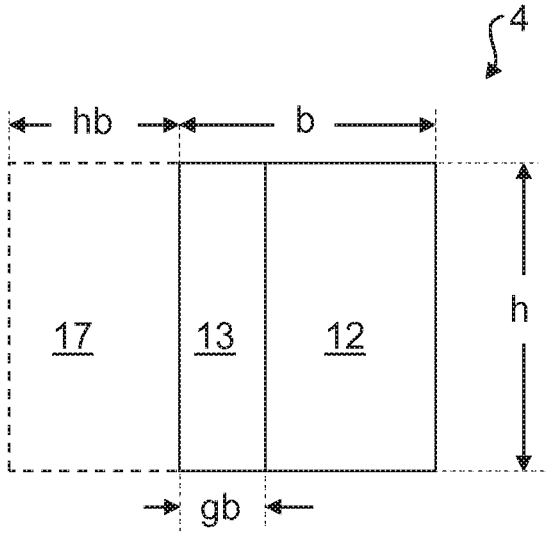
FIG. 2 shows a front view of one of the recessed handles.
Figure 3:
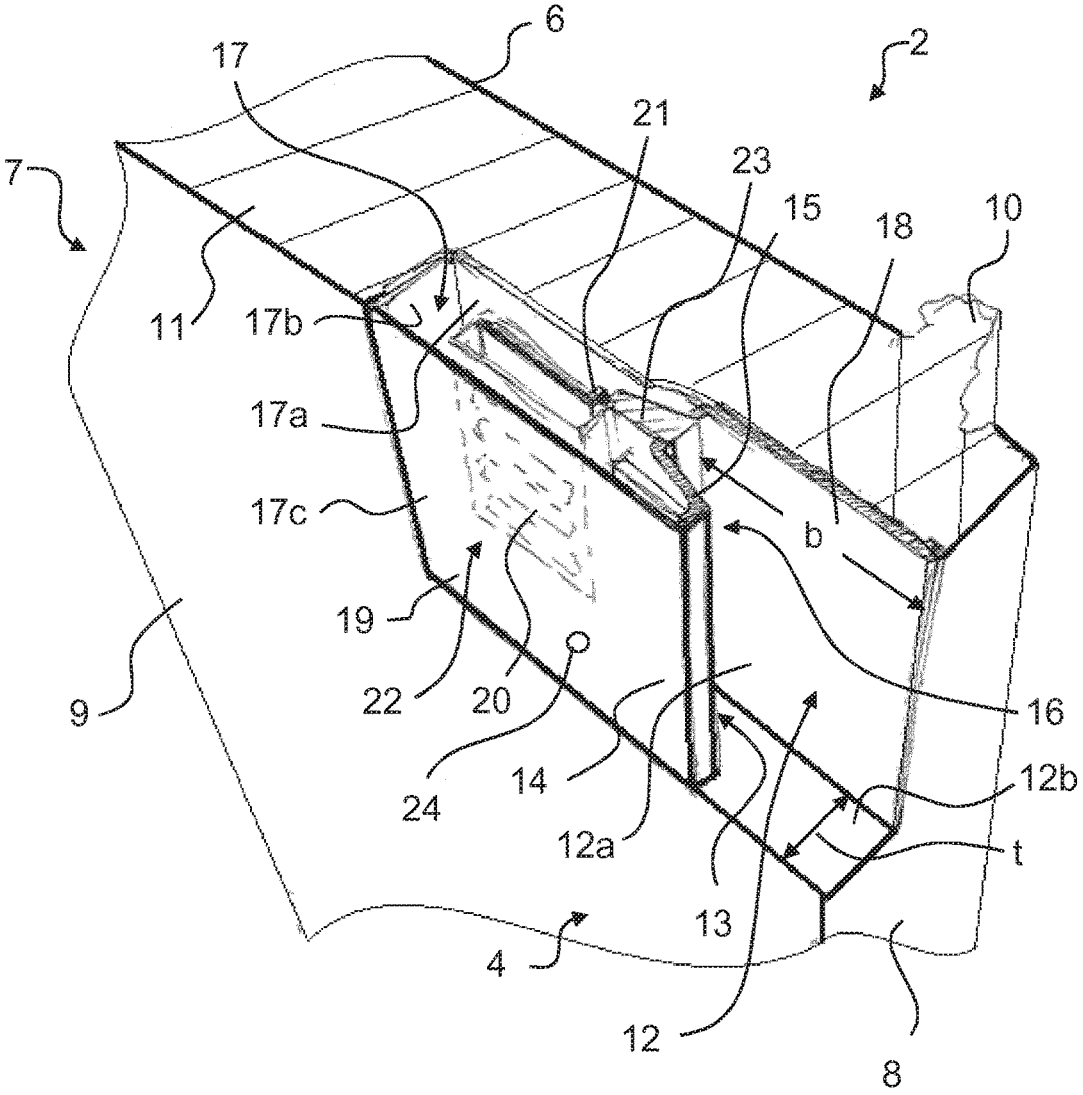
FIG. 3 shows a perspective view of a section of part of one of the door leaves in the region of its recessed handle.

The first door leaf 2 is provided to close the first chillable interior chamber. The first chillable interior chamber can be accessed when the first door leaf 2 is open. The first door leaf 2 is supported in such a manner that it can be pivoted in relation to a vertical axis and in the present exemplary embodiment it is hinged for example by means of hinges on the left of the body of the domestic refrigeration appliance 1. A number of door trays for storing food can be arranged on the inner face of the first door leaf 2 facing in the direction of the first chillable interior chamber. The first door leaf 2 also has a recessed handle 4 in its outer face 7 facing away from the first chillable interior chamber. The recessed handle 4 is arranged in the region of a vertically running, initially side face 8 of the first door leaf 2 facing the second door leaf 3. A front view of the recessed handle 4 of the first door leaf 2 is shown in FIG. 2. A perspective view of part of the first door leaf 2 along the line A-A is shown in FIG. 3.

The second door leaf 3 is provided to close the second chillable interior chamber. The second chillable interior chamber can be accessed when the second door leaf 3 is open. The second door leaf 3 is supported in such a manner that it can be pivoted in relation to a vertical axis and in the present exemplary embodiment it is hinged for example by means of hinges on the right of the body of the domestic refrigeration appliance 1. A number of door trays for storing food can be arranged on the inner face of the second door leaf 3 facing in the direction of the second chillable interior chamber. The second door leaf 3 also has a recessed handle 5 in its outer face facing away from the second chillable interior chamber. The recessed handle 5 of the second door leaf 3 is arranged in the region of the side face of the second door leaf 3 facing the first door leaf 2. The two recessed handles 4, 5 are at the same height.

In the present exemplary embodiment the inner face of the first door leaf 2 is formed by an inner skin 6. The inner skin 6 is made of plastic or metal for example. The several door trays of the first door leaf 2, if present, can be arranged on the inner skin 6, it being possible for fastening devices for the door trays to be molded on the inner skin 6.

A peripheral seal 10 is preferably fastened to the inner skin 6, sealing the first chillable interior chamber when the first door leaf 2 is closed. The seal 10 is fastened for example by means of holders molded on the inner skin 6.

In the present exemplary embodiment the outer face 7 of the first door leaf 2 is formed at least mostly by an outer skin 9. The outer skin 9 is made of plastic or metal for example. The materials of the inner skin 6 and outer skin 9 can be the same or different.

The first door leaf 2 has the vertically running first side face 8 facing the second door leaf 3 and a second side face opposite the first side face 8, in the region of which second side face the first door leaf 2 is hinged to the body for example by means of the hinges.

The first side face 8 and the second side face of the first door leaf 2 can be formed by the inner skin 6, as shown in FIG. 2.

The hollow space formed by the inner face and the outer face 7 of the first door leaf 2 is filled in particular with an insulating foam 11, to which the inner skin 6 and outer skin 9 in particular adhere.

In the present exemplary embodiment the recessed handle 4 of the first door leaf 2 is formed in that a depression 12 corresponding to the size of the recessed handle 4 is formed in the outer face 7 of the first door leaf 2 in the region of said recessed handle 4. The depression 12 reaches to the first side face 8 of the first door leaf 2. The depression 12 or the recessed handle 4 in particular has a width b, a depth t and a height h.

The depression 12 comprises in particular a wall 12*a* running vertically and terminating the depression 12 or the recessed handle 4 in the direction of the inner face of the first door leaf 2 with the height h and width b of the depression 12, a lower wall 12*b* running horizontally and terminating the depression 12 or the recessed handle 4 in a downward direction with the width b and depth t of the depression 12 and an upper wall running horizontally and terminating the depression 12 or the recessed handle 4 in an upward direction with the width b and depth t of the depression 12.

The recessed handle 4 also has a grip 13 which partially covers the depression 12 over a grip width gb, starting from the end of the depression 12 facing away from the first side face 8 of the first door leaf 2. The grip width gb is smaller, in particular much smaller, than the width b of the depression 12. The height of the grip 13 corresponds to the height h of the depression 12. In particular the outward facing surface 14 of the grip 13 runs flush with the surface of the outer face 7. The grip 13 or the face 15 of the grip 13 facing the depression 12 and the depression 12 form a point of engagement or indentation 16, in which the hand of a person can engage to open the first door leaf 2.

In the present exemplary embodiment a hollow space 17 is provided within the first door leaf 2 immediately next to the recessed handle 4. The hollow space 17 has in particular the same height as the recessed handle 4. The depth of the hollow space 17 also corresponds at least approximately to the depth t of the recessed handle 4. The hollow space 17 has a hollow space width hb.

The hollow space 17 comprises in particular a rear wall 17*a* with the width hb and the height of the hollow space 17, a side wall 17*b* facing away from the recessed handle 4, a front wall 17*c* opposite the rear wall 17*a*, a lower wall running horizontally and terminating the hollow space 17 in a downward direction with the width hb and the depth of the hollow space 17 and an upper wall miming horizontally and terminating the hollow space 17 in an upward direction with the width hb and the depth of the hollow space 17. The rear wall 17*a*, the side wall 17*b*, the lower wall and the upper wall of the hollow space 17 adhere to the insulating foam 11. The outward facing surface of the front wall 17*c* preferably runs flush with the outward facing surface of the outer skin 9 of the first door leaf 2. The hollow space 17 is separated from the recessed handle 4 by a vertical wall 17*c*, the face of which facing the recessed handle 4 is part of the indentation 16.

The recessed handle 5 of the second door leaf 5 is also embodied as a point of engagement or indentation formed in relation to the front face of the second door leaf 3. It has in particular the form of a channel 5*a* arranged in the side face facing the first door leaf 2, the length of said channel 5*a* corresponding to the height h of the depression 12. This allows a person's hand to engage in the indentation of the recessed handle 5 of the second door leaf 3 embodied as the channel 5*a* by way of the depression 12 of the first door leaf 2 to open the second door leaf 3.

In the present exemplary embodiment the recessed handle 4 and the hollow space 17 of the first door leaf 2 are realized in that the outer skin 9 of the first door leaf 2 has a cutout corresponding to the width hb, h and height h of the hollow space 17 and the recessed handle 4.

The depression 12 is formed in particular by a first part 18, which is made of plastic for example. The part 18 is preferably embodied as a single piece and forms a vertically running wall 12*a*, the downwardly terminating, horizontally running lower wall 12*b* and the upper wall of the depression 12 with the width b and the depth t of the depression 12.

In the present exemplary embodiment the first part 18 preferably also forms the indentation 16 and in particular the grip 13 of the recessed handle 4.

The walls delimiting the hollow space 17 can be formed by a further part made of plastic for example, which at least partially forms a housing for a further assembly 22 described below. However the first part 18 preferably also forms the rear wall 17*a*, the side wall 17*b*, the lower wall and the upper wall of the hollow space 17, as well as the wall 17*d* separating the hollow space 17 and the recessed handle 4, in other words part of the housing for the assembly 22.

In the present exemplary embodiment the front wall 17*c* of the hollow space 17 is preferably formed by a second part 19. The second part 19 is preferably made of metal but can also be made of plastic. The second part 19 is in particular a cover covering the hollow space 17. The cover or second part 19 preferable runs flush with the outer skin 9.

Figure 4:
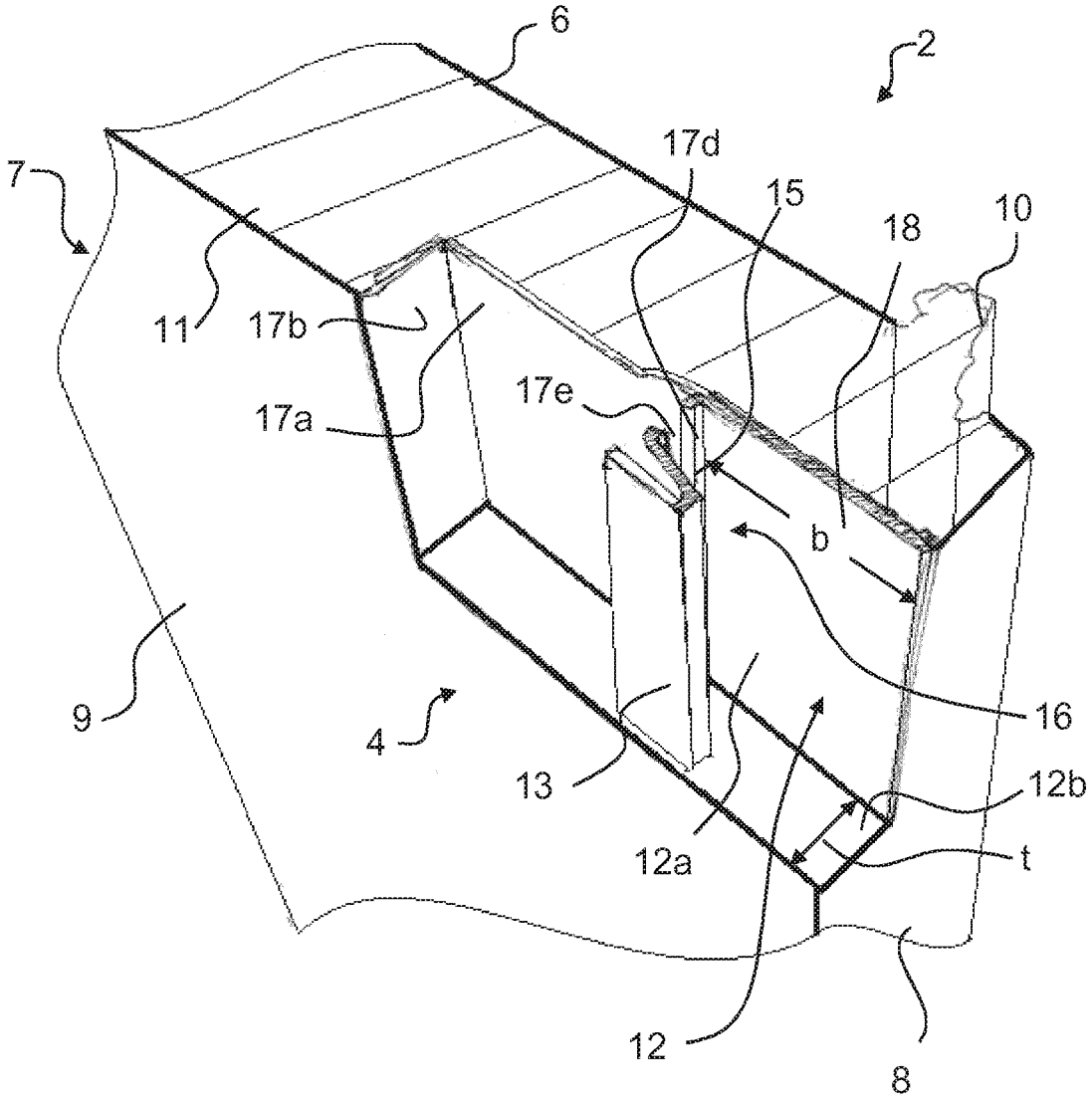
FIG. 4 shows a section of the part of the door leaf shown in FIG. 3 as it is being mounted.

The second part 19 is in particular embodied in such a manner that it also forms the surface 14 of the grip 13 running flush with the surface of the outer skin 9 or serves as a cover for the grip 13. FIG. 4 shows the part of the first door leaf 2 shown in FIG. 3 without the second part 19.

The hollow space 17 is provided to hold the electronic control apparatus of the domestic refrigeration appliance 1, or at least its electronics system 20 or at least a large part of the electronics system 20. A network part of the electronic control apparatus is preferably fastened in or to the body of the domestic refrigeration appliance 1 so that no cables carrying a network voltage have to be passed through the first door leaf 2 to the electronics system 20. Electric cables required for the operation of the electronics system 20 are laid in particular in the insulating foam 11 of the first door leaf 2 and are not shown for the sake of clarity.

The electronics system 20 fastened within the hollow space 17 comprises in particular a printed circuit board, to which electrical and electronic parts, for example a microcontroller or a microprocessor, are fastened.

The domestic refrigeration appliance 1 further comprises a lighting arrangement provided to illuminate the recessed handle 4 of the first door leaf 2. This is configured in particular in such a manner that it illuminates the depression 12 and by way of the depression 12 also the recessed handle 5 of the second door leaf 5, in particular its indentation configured as the channel 5*a*.

The lighting arrangement of the recessed handle 4 is arranged in such a manner that it radiates its light out of the indentation 16 of the recessed handle 4.

The lighting arrangement comprises at least one lighting means, preferably in the form of at least one LED 21. The at least one lighting means or the at least one LED 21 is combined with the electronics system 20 of the assembly 22 in that for example the at least one lighting means or the at least one LED 21 is fastened to the printed circuit board of the electronics system 20. The electronics system 20 and the at least one lighting means or the at least one LED 21 are therefore combined to form a single, common assembly in the assembly 22.

In the present exemplary embodiment the hollow space 17 is separated from the recessed handle 4 by the vertical wall 17*d*. This vertical wall 17*d* is preferably formed by the first part 18. Its surface facing away from the hollow space 17 is part of the indentation 16 of the recessed handle 4. This vertical wall 17*d* can have at least one opening, through which the light from the at least one lighting means or the at least one LED 21 is able to radiate to illuminate the recessed handle 4 of the first door leaf 2 and optionally also the recessed handle 5 of the second door leaf 3. This at least one opening can be covered by an at least semi-transparent cover. The first part 18 is therefore preferably a housing for the assembly 22 that is open in the direction of the outer face 7 and on which the walls 12*a*, 12*b* forming the depression 12 are molded as a single piece.

In the present exemplary embodiment the at least one opening is configured as a vertically running slot 17*e* in the wall 17*d* separating the recessed handle 4 and the hollow space 17, said slot 17*e* preferably running over the entire height h of the depression 12 or the wall 17*d*. In particular the slot 17*e* is provided with a light guide 23, which in particular completely covers or fills the slot 17*e*. The light guide 23 is in turn coupled optically to the at least one lighting means or the at least one LED 21, so that the light from the at least one lighting means or the at least one LED 21 is able to illuminate the depression 12 or the recessed handles 4, 5 by way of the light guide 23. The light guide 23 is preferably also part of the assembly 22.

The domestic refrigeration appliance 1 can be embodied in such a manner that the lighting arrangement of the recessed handles 4, 5 is embodied as what is referred to as a night design. In particular the light from the at least one lighting means or the at least one LED 21 can be colored. A colored filter can also optionally be provided between the light guide 23 and the at least one lighting means. It is also possible for the light guide 23 to be colored.

The lighting arrangement can optionally also be embodied as interactive in that for example the electronics system 20 automatically activates the at least one lighting means or the at least one LED 21 when a person approaches the domestic refrigeration appliance 1 or the recessed handle 4. To this end the domestic refrigeration appliance 1 can comprise for example a distance or proximity sensor 24 which is connected to the electronics system 20. The distance or proximity sensor 24 can be fastened for example in or to the outer face 7 of the first door leaf 2, preferably in or to the second part 19.

The lighting arrangement can also be used to visualize switching states or alarm states of the domestic refrigeration appliance 1. For example in the case of a door alarm the light of the lighting arrangement can assume a defined color, for example red. The door alarm is activated for example when one of the door leaves 2, 3 is open for a predefined time period. The lighting arrangement can optionally also flash with the alarm.

A so-called "holiday function" (standby function) for example could be indicated by white light from the lighting arrangement, in particular increasing and decreasing in intensity slowly, changing brightness at the speed of slow breathing.

The visualization of further functions such as "eco cooling" (energy saving mode) for example can be visualized by green light for example or "super" can be visualized by bright white light.

REFERENCE CHARACTERS

1 Domestic refrigeration appliance
2 First door leaf
3 Second door leaf
4 Recessed handle
5 Recessed handle
5*a* Channel
6 Inner skin
7 Outer face
8 Side face
9 Outer skin
10 Seal
11 Insulating foam
12 Depression
12*a* Lower wall
12*b* Wall
13 Grip
14 Surface
15 Face
16 Indentation
17 Hollow space
17*a* Rear wall
17*b* Side wall
17*c* Front wall
17*d* Wall
17*e* Slot
18 First part
19 Second part
20 Electronics system
21 LED
22 Assembly
23 light guide
24 Proximity sensor
b Width
gb Grip width
h Height
hb Width
t Depth

The invention claimed is:

1. A domestic refrigerator, comprising:

an interior chamber provided for storage of food;

a thermally insulated body and an inner container delimiting said interior chamber:

a door leaf for opening and closing said interior chamber, said door leaf having an inner face facing toward said interior chamber, an outer face facing away from said interior chamber and an insulating foam disposed between said inner face and said outer face of said door leaf;

a recessed handle disposed in said outer face of said door leaf, said recessed handle including a grip forming an indentation being recessed relative to said outer face of said door leaf;

a lighting configuration having at least one lighting device configured to illuminate said recessed handle;

a refrigeration apparatus configured to chill said interior chamber;

an electronic control apparatus having an electronics system, said electronic control apparatus being configured to control said refrigeration apparatus during operation of the domestic refrigerator in such a manner that said interior chamber has at least approximately a set point temperature; and at least a majority of said electronics system and said at least one lighting device forming a common assembly disposed within said door leaf next to said indentation for permitting said at least one lighting device to radiate light out of said indentation into said recessed handle.

2. The domestic refrigerator according to claim 1, wherein said at least one lighting device is an LED.

3. The domestic refrigerator according to claim 1, wherein said common assembly has a printed circuit board to which said at least one lighting device and electrical and electronic parts of said electronics system are fastened.

4. The domestic refrigerator according to claim 1, wherein:

said door leaf has a hollow space formed therein next to said indentation of said recessed handle;

said common assembly is fastened in said hollow space; and a wall disposed in said indentation separates said hollow space and said recessed handle, said wall has at least one opening formed therein through which the light from said at least one lighting device can radiate to illuminate said recessed handle.

5. The domestic refrigerator according to claim 1, wherein said recessed handle has a depression being only partially covered by said grip forming said indentation.

6. The domestic refrigerator according to claim 1, wherein:

said door leaf is pivotable about a vertical axis;

a further door leaf is disposed next to said door leaf, is pivotable about a vertical axis, has an inner face and an outer face and includes a further recessed handle disposed in said outer face of said further door leaf; and said further recessed handle includes a grip forming an indentation being recessed relative to said outer face of said further door leaf.

7. The domestic refrigerator according to claim 1, wherein:

said door leaf has a hollow space formed therein next to said indentation of said recessed handle;

said common assembly is fastened in said hollow space;

a wall disposed in said indentation separates said hollow space and said recessed handle, said wall has at least one opening formed therein through which the light from said at least one lighting device can radiate to illuminate said recessed handle;

said outer face of said door leaf has an outer skin adhering to said insulating foam, said outer skin has a cutout and a recess in said cutout forming said hollow space having a housing for said common assembly being manufactured as a single piece and being open toward said outer face in said insulating foam; and a cover outwardly covers said hollow space.

8. The domestic refrigerator according to claim 7, wherein said recessed handle has a depression formed therein defining walls being molded on said open housing for said common assembly, and said depression is only partially covered by said grip forming said indentation.

9. The domestic refrigerator according to claim 4, wherein said lighting configuration has a light guide coupled optically to said at least one lighting device, and said light guide is coupled optically to said at least one opening.

10. The domestic refrigerator according to claim 4, wherein said light guide at least partly closes off said at least one opening.

11. The domestic refrigerator according to claim 4, wherein said light guide is part of said assembly.

12. The domestic refrigerator according to claim 6, wherein:

said door leaf and said further door leaf each have a respective side face;

said recessed handle of said door leaf is disposed in a vicinity of said side face of said door leaf facing said further door leaf;

said further recessed handle of said further door leaf is disposed in a vicinity of said side face of said further door leaf; and said recessed handles of said door leaf and said further door leaf are at identical heights permitting said lighting configuration to also illuminate said further recessed handle.

* * * * *